United States Patent [19]

Searcy

[11] 4,154,027

[45] May 15, 1979

[54] STORE ARRANGEMENT

[75] Inventor: William Searcy, Tarpon Springs, Fla.

[73] Assignee: Tyler Refrigerator Corporation, Niles, Mich.

[21] Appl. No.: 826,813

[22] Filed: Aug. 22, 1977

[51] Int. Cl.[2] ..... E04H 3/04

[52] U.S. Cl. ..... 52/33; 52/234; 186/1 R

[58] Field of Search ..... 52/33, 27, 36, 169.2, 52/169.3, 234; D25/58, 35

[56] References Cited

U.S. PATENT DOCUMENTS

| | | | |
|---|---|---|---|
| 1,345,481 | 7/1920 | Davis | 52/33 |
| 1,392,418 | 10/1921 | Hill | 52/33 |
| 1,404,613 | 1/1922 | Hormes | 52/33 X |
| 1,461,374 | 7/1923 | Anderson | 52/33 |
| 1,463,633 | 7/1923 | Smith | 52/33 |
| 1,474,106 | 11/1923 | Carroll | 52/33 |
| 1,528,243 | 3/1925 | Briggs | 52/33 |
| 1,717,123 | 6/1929 | Sharp | 52/33 X |
| 1,861,671 | 6/1932 | Webb | 52/36 X |
| 2,285,962 | 6/1942 | Foulkes | 52/33 X |
| 3,742,932 | 7/1973 | Greenspan | 52/33 |

FOREIGN PATENT DOCUMENTS

| | | | |
|---|---|---|---|
| 255554 | 7/1926 | United Kingdom | 52/33 |

*Primary Examiner*—Leslie Braun
*Attorney, Agent, or Firm*—LeBlanc & Shur

[57] ABSTRACT

A store arrangement including a combination, self-service and service establishment having a central portion with a display structure and a service counter. Shopping aisles are located on substantially all sides of the central portion to provide access to the central portion from substantially all points in the store. The central portion is configured to provide services for the patron as well as check-out items purchased.

12 Claims, 11 Drawing Figures

STORE ARRANGEMENT

BACKGROUND OF THE INVENTION

Typically, in retail service establishments and in particular, self-serving stores selling groceries and the like, the store is characterized by aisles defined between multitudes of rows of display shelves or other containers for holding and displaying the goods for sale. In such stores, the checkout counter is usually located near the front of the store adjacent the entrance and exit areas. The problem with the configuration of this type of store is that the patron is unable from the checkout counter to readily locate the goods sold in every other part of the store. Often the patron is required to go to each aisle to determine whether it contains the goods the patron desires to purchase. Then, if the patron cannot quickly locate the item he or she is looking for he must go all the way to the front of the store to get information from the service personnel who work at the checkout counters.

In addition, the only function served by the checkout counter is to register the goods sold and take cash, give change, cash checks and other tasks connected with merely purchasing the items picked-up in a basket as the patron has moved about the store. As a result, often the purchaser who is interested in getting some items which require additional attention, for example, buying meats, where the meat is required to be cut to specification, the patron must go to one part of the store to get the meat cut, weighed, etc., and then come to another part of the store to have it checked out where the patron can pay for the meat that has been bought. This problem also exists with fruits and other produce which require special service.

The problem with this type of configuration is that significant time is wasted by both the patron and the service people. Although there are some stores which have a checkout counter in the center of the store. Their major function is simply to register and check out items purchased elsewhere in the store. They typically provide no other services or any work area for wrapping, cutting, weighing, etc., of other items which can be purchased in the store.

SUMMARY OF THE INVENTION

The invention defined herein generally relates to a combination checkout and service area located substantially in the center of a retail establishment to provide easy access to the patrons from other self-service parts of the store and also to provide additional service to the patrons so that they will not be required to go to remote parts of the store and return to the service counter. The combination checkout and service area is configured to provide a multitude of services for the patron as well as a checkout counter where the goods purchased can be itemized, registered and paid for. In addition, this configuration allows patrons to readily have available the entire surrounding store so that any information needed concerning the location of any items can be easily pointed out to the patron.

More particularly, as described in the description of the preferred embodiment, the combination checkout and service area is characterized by a U-shaped central member lying substantially in the center of the store. The U-shaped central member is comprised of a bottom member and two side members extending therefrom The store is generally rectangular in configuration being defined by four walls, a front wall, a rear wall and a first and second side walls. The bottom member of the U-shaped central member is parallel to the front wall and the two side members are parallel to the first and second side walls of the store respectively. In the center of the U-shaped member, there is located a work table in a manner which provides aisle space between the work table and the U-shaped central member so that the service personnel can readily move from the table to other various parts of the central member. Displaced from one end of the table and mid-way between the ends of the U-shaped member is a hand sink which allows the service personnel to cleanse the various items being purchased by the patrons as well as to maintain their own personal hygiene as they are constantly in contact with the meats, deli products, cheeses and other fresh produce which are being sold to the patrons.

Extending from the rear of the store is a dairy and beverage cooler, including glass display cases which are readily accessible to the patrons. Also extending from the rear wall and adjacent to the dairy and beverage cooler is a bottle storage and stock room having access from the main store room so that the service people can store returned bottles and other dry goods. Sufficient space is provided between the central portion and the side walls so that additional display cases can be placed therebetween with desirable aisle space so that the patrons can move readily therethrough to get the desired items displayed in the cases. Adjacent the second wall there is also provided a bulk bakery display with shelves for displaying bread that is baked on the premises as well as other breads made by manufacturers outside the store.

The arrangement also includes a silo area which defines a specialty shop and gas office shop located in a corner of the store between the front wall and the second side wall. The silo area is characterized by a generally cylindrical configuration having a substantial portion thereof opened into the store for access by the patrons. Half of this area is used for a specialty shop such as tobaccos and the like, while the other half is used as a gas office to monitor self-service gas pumps which may be located outside the store. Other elements of the arrangement and those elements described above are discussed in more detail in the Detailed Description of the Preferred Embodiment.

BRIEF DESCRIPTION OF THE DRAWINGS

FIGS. 3*a*, 3*b*, 3*c* and 3*d* are respectively, elevation views of the bottom member, the first side member, the second side member, and top member of the central portion of the store arrangement.

FIGS. 4*a*, 4*b*, 4*c*, and 4*d* are respectively, elevation views of the front wall, the first side wall, the second side wall, and the rear wall of the store arrangement.

DETAILED DESCRIPTION OF THE PREFERRED EMBODIMENT

Figure 1:
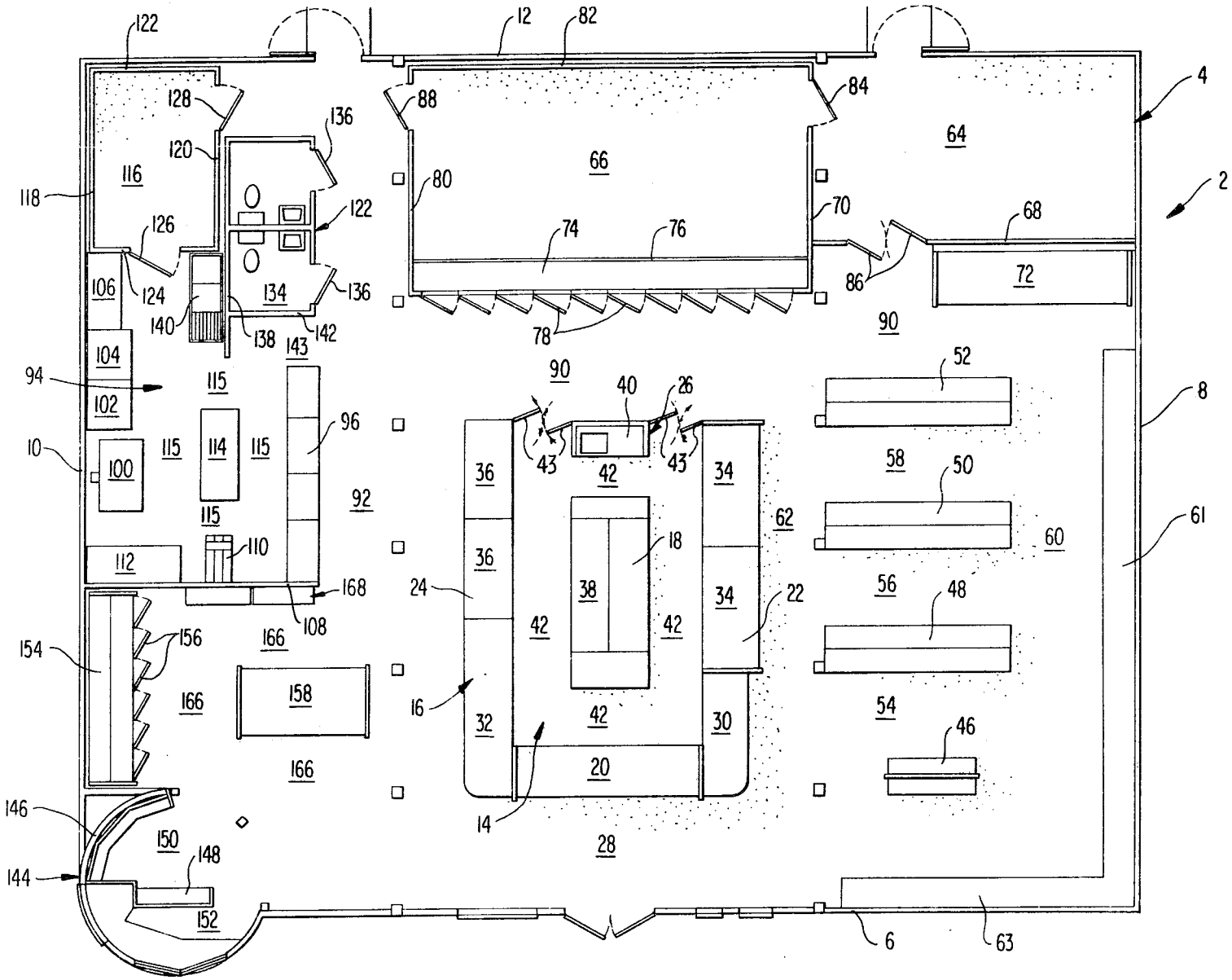
FIG. 1 shows a layout floor plan of the entire store arrangement.

Referring to FIG. 1, the floor plan 2 of a store arrangement is generally characterized by a rectangular enclosure 4 having a front wall 6, a first side wall 8, a second side wall 10 and a rear wall 12. Centrally located on the floor plan there is a central service portion 14 to provide easy access from every area of the store for the patrons and to provide efficient service from the personnel operating the central portion 14.

More particularly, the central portion 14 includes a U-shaped member 16 having a work section 18 defined in the center thereof. The U-shaped member 16 has a bottom member 20 which extends parallel to the front wall, immediately behind a door entrance therethrough, a first side member 22 and a second side member 24 extending perpendicularly from said bottom member toward the rear wall 12 and parallel to each other. Said U-shaped member 16 also includes a top member 26 which will be more fully explained later in this description. The bottom member 20 is displaced from the front wall 6 to define a front aisle 28 between it and the front wall 6 for easy movement therethrough by the patrons with their shopping carts.

With reference to FIGS. *3a, 3b, 3c,* it can be seen that each side member 22,24 is divided into a lower portion having a service area and an upper portion having a display area. The lower portion of the side members each includes a service counter 30,32 adjacent said bottom member 20, and the upper portion includes a display case 34,36. Specifically, the case 34 is a refrigerator case for bulk cheeses, and the case 36 is a non-refrigerated bakery display case. The bottom member 20 is also a refrigerated display case for meats and deli items.

In the center of the U-shaped member 16 is a work table 38 which provides an area for the service personnel to perform various functions in connection with the goods being sold from the U-shaped member 16 as well as other areas of the store. More particularly, the work table is sufficiently large to provide an area for supporting a slicer, scale, steamer, shredder and other items needed in connection with operating a deli and preparing bulk cheese, bakery items and other such goods for sale. In addition, the table 38 is large enough to provide space for wrapping the goods sold as well as supporting the aforementioned items. The top member 26 of the U-shaped member includes a hand sink 40 displaced from the wall table and approximated midway between the ends of the display cases 34,36. As the service personnel will be constantly handling the cheese, meats, other produce and goods on the service counters 30,32 and on the work table, the hand sink provides a means for constantly cleansing the hands of the personnel as well as washing other goods being sold as required.

Figure 2:
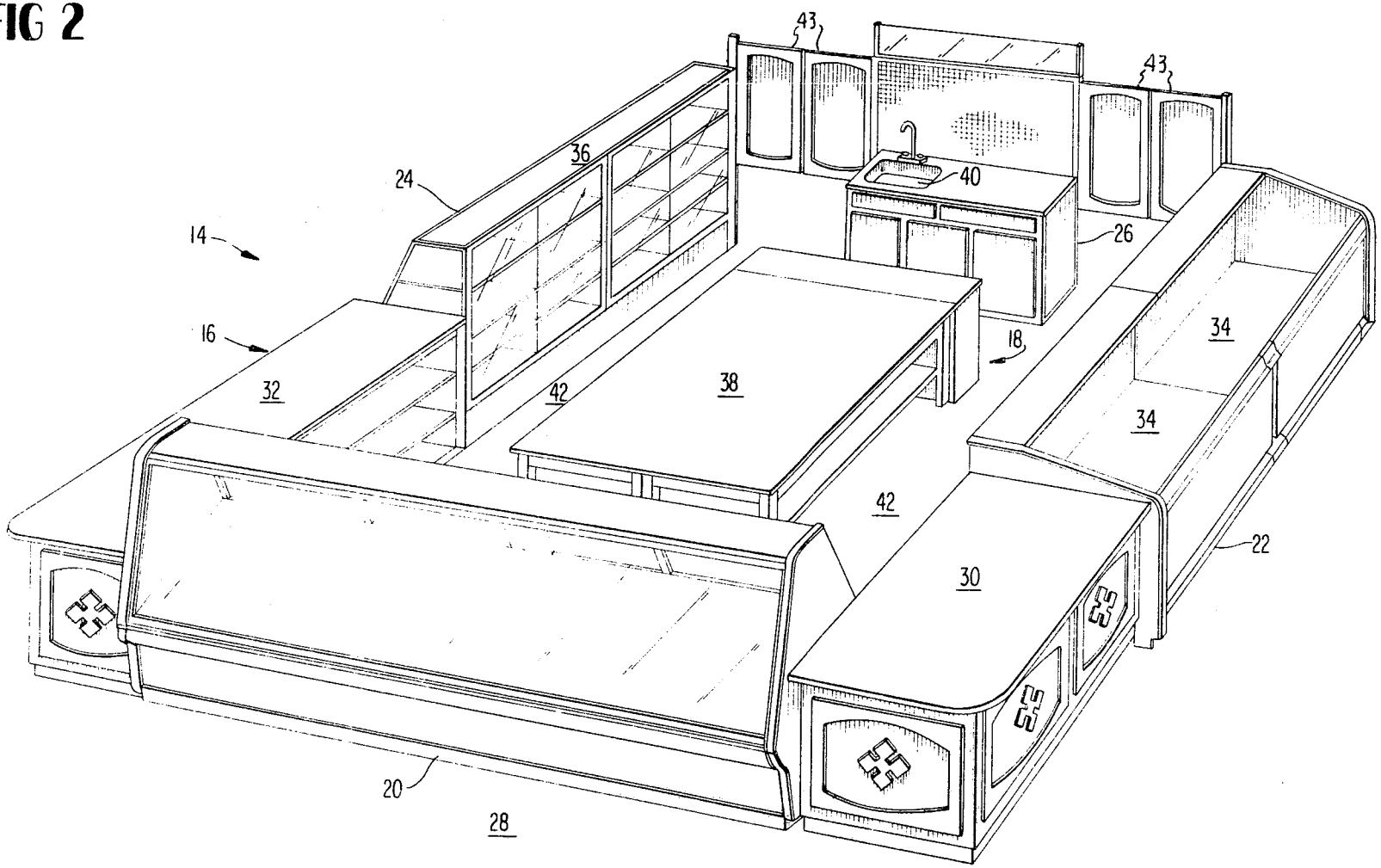
FIG. 2 is a perspective view of the central portions of the store arrangement.
Figure 3A:
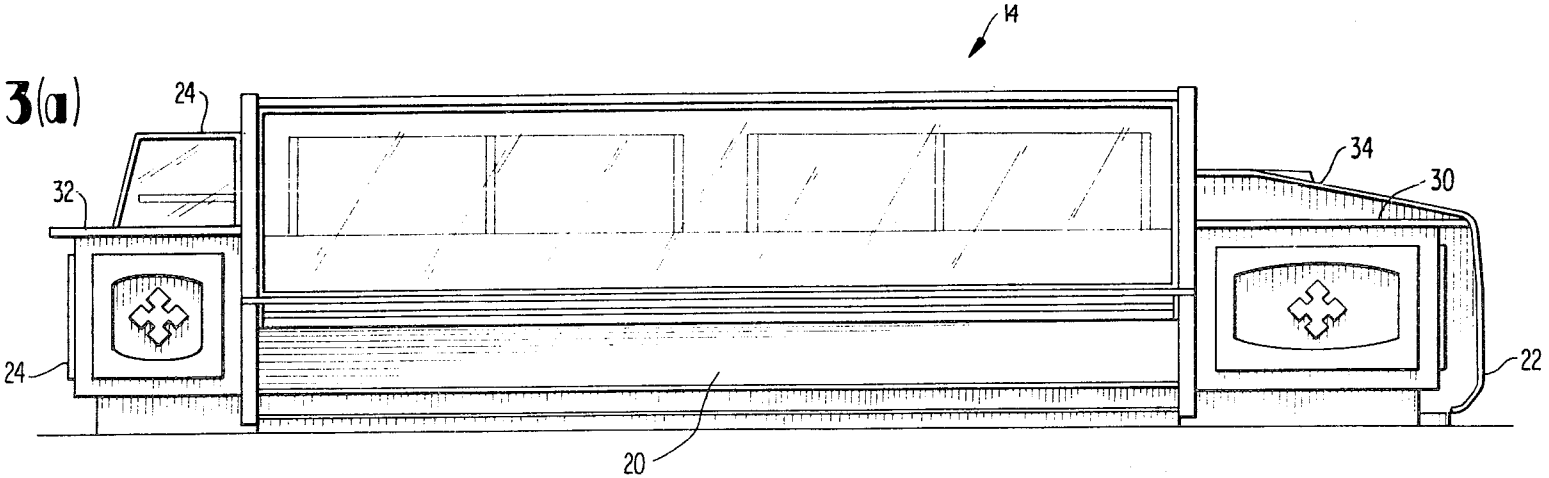
Figure 3D:
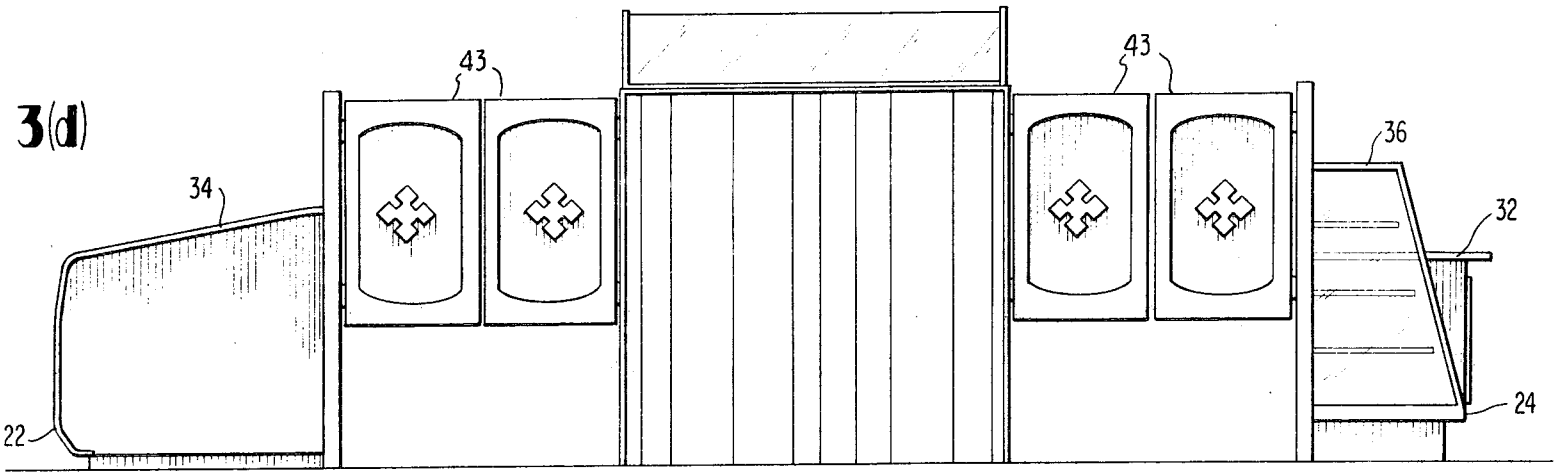

The work table 38 is displaced from the hand sink 40, the side members 22, 24 and bottom member 20 of the U-shaped member to define aisle 42 therearound so that the service personnel can readily move from one area to another and completely around the work table itself. Entrance to aisle 42 is provided through doors 43 on either side of the sink 40. This configuration as shown in FIG. 2 allows the service personnel to move quickly from any portion of U-shaped member 16 to the work table 38 and back in preparing items for sale such as slicing meats and cheeses for patrons in the area of the central portion of the store. Because of the proximity of work table 38 to the checkout counter and the display cases 34, 36 of the U-shaped member 16, the service personnel are able to serve the needs of those customers at a single location. This is particularly advantageous for those patrons who want deli-items, cheeses and bakery items which are often the single purchase goods where the customer wants quick and efficient service without being delayed by searches through multitudes of aisles and waiting in long queues for checkout. With these single purchase items the customer or patron can be served and checked out at the same location resulting in conservation in time with little or no frustration.

Additional features of the store include the arrangement of other display structures and service areas in their relationship to the central portion 14. The arrangement is one where substantially every display structure is visible from the central portion 14 of the store allowing the patron to immediately locate the goods which he desires to purchase. These and other advantages result from this arrangement more fully described hereinafter.

The side member 22 of the U-shaped member 16 is parallel to the first side wall 8 and is sufficiently displaced from the first side wall 8 to provide for four free-standing display cases 46, 48, 50, 52 arranged in a series from the front wall 6 toward the rear wall 12. As can be seen in FIG. 1, each display case 46, 48, 50, 52 is displaced from the other a sufficient distance to provide an aisle 54, 56, 58 therebetween for easy access by the customer to cases 46, 48, 50, 52 as well as between the central portion 16 and the first side wall 8. In addition, the free-standing cases 46, 48, 50, 52 are located between the first side wall 8 and the first side member 22 of the U-shaped member 16 to provide parallel aisles, a first side wall aisle 60 and a first counter aisle 62, on either side thereof and parallel to the first side wall 8 again for easy access and use by the customer. In this manner, the customers can readily move between the free-standing cases 46, 48, 50, 52 and between the first side member 22 of the U-shaped member 16 and the first side wall 8.

The free-standing case 46 is smaller than the other cases 48, 50, 52 and is located centrally between case 48 and the front wall 6 as well as the first side wall 8 and the service counter 30. In the preferred embodiment, this smaller free-standing case 46 contains barrels of coffee display. By being located in the front of the store, and centrally located as described, the coffee can be readily seen and obtained by customers entering through the front door. As coffee is one of the items which is typically bought independently of many items, this location provides high visibility and easy access to and from the service counter for those purchasers who wish to buy coffee only.

The first side wall 8 has extending therefrom a series of shelves 61 as shown in FIG. *4b* for holding general grocery items such as dry goods and canned goods. As an alternative, fruit refrigeration cases could be employed entirely in lieu of the grocery shelving or forming a bottom portion thereof with the grocery shelving extending from the fruit cases toward the ceiling. Whether it is grocery shelving or fruit shelving alone, or in combination, these do not extend along the entire wall, but extend from the front wall to an area adjacent the last-most free-standing case 52. Similarly, on the front wall 6 (as shown in FIG. *4a*) there are shelves 63 which extend from the first side wall 8 to first counter aisle 62. As with shelves 61, the shelves 63 may have alternatives but in this preferred embodiment they are used for displaying general grocery items. These shelves 63 are displaced from case 46 by a portion of front aisle 28. The cases 46, 48, 50, 52 may be replaced by alternatives as described with respect to shelves 61 as well as refrigerated cases.

Adjacent the rear wall 12 there are store rooms 64, 66 for goods which need not be immediately displayed but are stored for future display or other purposes. Particularly, the room adjacent the first side wall 8 is a bottle storage stock room 64. Adjacent the stock room and forming the remainder of these rooms is a dairy and beverage cooler 66. The stock room 64 includes a stock room wall 68 which extends into the store arrangement perpendicularly from the first side wall 8. The remainder of the stock room 64 is formed of common wall 70 and a portion of rear wall 12 and first side wall 8 as can be seen in FIG. 1. Extending from the stock room wall 68 is a refrigerated milk and egg display case 72. The front portion of the cooler 66 is defined by display shelves 74, as shown in FIG. 4*d*, having glass display doors 78 which can be opened readily by the customers for easy access to the shelves 74. Since the shelves contain dairy and other beverage goods, it is necessary that they be refrigerated. In addition, the cooler 66 behind the display shelves is also refrigerated so that these particular items can be kept at a proper temperature and readily replace items on the shelves as they are depleted by the customers.

In addition to the cooler front wall 76, the cooler 66 is enclosed by cooler side wall 80, cooler rear wall 82, and common wall 70 which as explained above also forms part of the stock room 64. Between the common wall 70 and the stock room front wall 68 there are swinging doors 86 to allow access by the store personnel between the store and the stock room. It should also be noted that there is a common wall door 84 between the stock room 64 and the beverage cooler 66 allowing access between these two areas without having to go into the aisles interferring with the customers moving throughout the store. There is also provided a door 88 in the cooler side wall 80 to provide access to the cooler 66 directly from the store.

The room 64,66 and more particularly, the cooler display shelves 74 and the milk and egg display case 72 are displaced from the top member 26 of the U-shaped member 16, the last display case 52 and the end of shelves 61 to form rear aisle 90, extending from the first side wall 8, parallel to the front wall 6 to a location adjacent the intersection of the cooler side wall 80 and the cooler front wall 76. As with the other aisles, the rear aisle 90 achieves for the customer easy access to the goods stored in shelves and cases adjacent the aisle as well as access to the central portion 14.

Intersecting rear aisle 90 is a second counter aisle 92 displaced from but parallel to the second side wall 10 and extending substantially the entire width of the store from the front wall 6 to the rear wall 12. Along the second side wall 10 adjacent second counter aisle 92 there is provision for various displays and work areas, as can be seen in FIGS. 1 and 4*c*. For example, in a bakery area 96, displaced from the second wall 10 and parallel thereto are a bulk bakery display shelves 96 with open-back for rear service. Behind the bakery display 96 against the second wall 10 are the various applicances for use in baking bread, pizza, pastry, etc. Specifically, these include a two-pan per deck, four deck oven 100, a proof-box 102, a retard cooler 104 and supply shelves 106. From FIG. 1 it can be seen that these are aligned adjacent one another along the second wall 10 directly opposite the bulk bakery display shelves 96.

To separate the bakery area from the front portion of the store, there is provided a bakery room wall 108 extending perpendicularly to the second wall 10 as can be seen in FIG. 1. Adjacent the bakery room wall 108, there is provided a bread slicer 110 for slicing the bread after it is baked in preparation for sale or customer request. At the corner of the second wall 10 and the bakery wall 108 there is provided a wall work table 112 for wrapping and other operations required in baking and preparing the other bakery goods for sale. There is a similar bakery work table 114 provided in the center of the bakery area between the oven 100 and the bulk bakery display shelves 96. The bakery work table 114 is generally located in the center of the bakery area between the oven 100 and the bulk bakery display shelves 96 such that there is an aisle 115 formed completely around the table 114 to allow the service personnel to move easily and quickly within the bakery area 94.

Between the bakery area 94 and the rear wall 12, there is provided a bakery and frozen food freezer room 116. Access to this room 116 can be made from the bakery area 94 as well as from the area near the rear wall 12. This bakery and frozen food freezer room 116 is defined by two side walls 118, 120, a rear wall 122, and a front wall 124 adjacent the bakery area 94. A swinging door 126 is provided along this freezer front wall 124 to provide the access between the bakery area 94 and freezing room 116. This allows the personnel to quickly obtain as needed, the dough, pastry, etc. which are kept frozen until ready for baking and other preparation processes required in getting these items prepared for sale. There is also a side door 128 to allow access to the freezer from the second counter aisle 92 so that personnel will not have to go through the bakery area to get other frozen goods in restocking shelf space.

Adjacent side wall 120 of the frozen food freezer room 116, there are provided toilet facilities 122 with access doors 136 from the second counter aisle separating these rooms from the dairy and beverage cooler room 66. A portion of rear wall 138 of the ladies room 134 extends into the bakery area 96 as can be seen in FIG. 2. Against this wall 138 a sink 140 and the bakery area is placed. Also, the side wall 142 of the ladies' room 134, forms a boundary for the bakery area 96 such that the only extrance and exit into the bakery area 96 from the aisle 92 of the store are through the open area 143 between the bakery display case 96 and the side wall 142.

Figure 5:
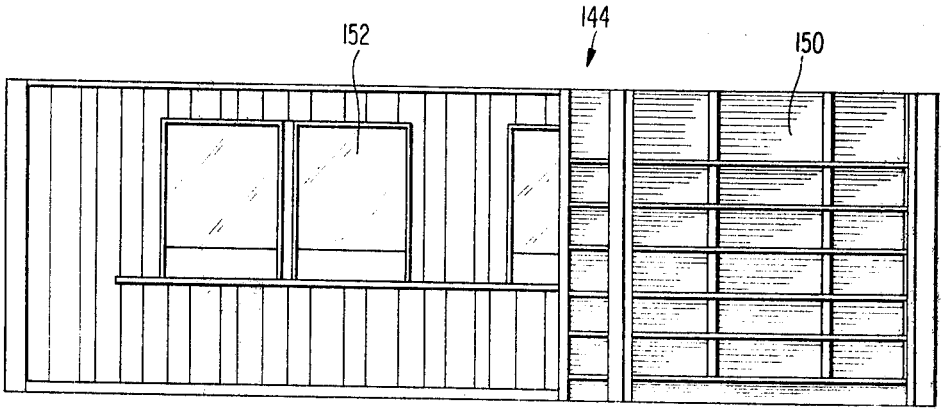
FIG. 5 is an unfolded view of the silo interior.

In the corner of the store defined by the front wall 6 and the second side wall 10, there is provided a cylindrical or silo area 144, a portion of which extends beyond the plane defined by the front wall 6. This cylindrical area 144 is defined by a cylinder-type wall 146 with a portion being left open and exposed to the interior of the store as shown. From FIG. 5, it can be seen that this cylindrical area is divided by a shelf 148 into two separate areas. In the preferred embodiment, the portion of the divided area exposed to the inner store is used as a tobacco shop 150 although any other specialty shop could be provided. The portion of the cylindrical area on the other side of the shelf 148 is the gas office 152 which has access to the outside so that those customers simply stopping for gas and tobacco do not have to enter the main store.

Between the cylindrical area and the bakery wall 108, adjacent the second side wall 10 there are provided low temperature cases 154 for ice cream and frozen food. These cases have a series of doors 156 to provide access for the patron. In the area between low temperature case 154 and the service counter 32 of the side member 24, there is a refrigerated bulk butter and pizza case 158. The bulk butter and pizza case 158 is located relative to the other items to provide aisle space 166 entirely around the case in addition to the second counter aisle so that customers can readily move by and to the case as desired.

With the above described arrangement several advantages are achieved which are helpful to the patrons and the service personnel as well. For example, as described earlier, the U-shaped member provides an area where the service personnel can both perform service functions such as cutting and wrapping cheeses, slicing and preparing meats and other deli items, etc., and check out functions such as itemizing purchases, bagging the purchased items, making change etc., simultaneously in one location. This enhances the efficiency of the personnel and convenience to the patrons. Also, all the shelves and aisles are located relative to the central portion so that they are easily found by the patron from the center of the store. From any aisle, a patron may go directly to the U-shaped member for service or checkout, and because of the central location, this service and checkout is readily accessible from any point in the store.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed is:

1. A store arrangement, comprising:

a substantially rectangular outer wall structure;

a substantially centrally located service section having a substantially U-shaped counter arrangement composed of spaced apart substantially parallel first and second side counter and a connecting end counter, and including a sink assembly located at and partially across the open end of the U-shaped counter arrangement, said sink assembly being spaced from the side counters to define an access space between the inside of the U-shaped service counter and the remainder of the store interior, and further including and island type work table located within the well of the U-shaped counter arrangement and spaced from the side and end counters thereof and from the sink assembly to thereby define walking space between the work table and the side and end counters and sink assembly;

a plurality of free-standing display structures located substantially equally spaced from one another and spaced between the first side counter and one side wall of said store a sufficient distance to provide aisles there between generally perpendicular to the first side counter and said one side wall of the store and to further define a first counter aisle between said free-standing display structures and the first side counter and a first wall aisle between said free-standing display structures and the first side wall generally parallel to said first counter aisle;

first, refrigerated, and second, non-refrigerated, store rooms adjacent to a rear store wall for storing items to be sold in the store, each room having a front wall displaced from said rear store wall and mounting display case thereon, at least the display case located on the front wall of the refrigerated room being a refrigerated display case accessible from the customer area and from the refrigerated room, wherein the wall mounted display case, on the one hand, and the end portions of the side counters and rearmost one of said free-standing display structures, on the other hand, define a rear store aisle as a generally perpendicular extension of said first wall and counter aisle;

a generally enclosed food preparation area located adjacent to a second side wall of the store, said food preparation area having a front wall spaced from said second store sidewall and mounting display cases thereon which are spaced from and substantially parallel to the second side counter to define a second counter aisle there between extending rearwardly from the front of the store to and forming a generally perpendicular extension of said rear store aisle; and a corner sales and service section located at the front of the store at one corner portion thereof, said corner section being partially enclosed from the main store interior but accessible to customer sales and/or service from both inside and outside the store.

2. The store arrangement according to claim 1, wherein said first side counter includes a first display case and a first service counter, and said second side counter defines a second display case and a second service counter longer than said first service counter, and said end counter includes an end display case, whereby service personnel can move quickly between the first, second and third display cases to and from the worktable to cut, weigh and otherwise prepare goods from the display cases and return to the appropriate service counter to register the sale of such items purchased by the customer.

3. The store arrangement according to claim 1 wherein said non-refrigerated room includes a storage and stock room being formed by a portion of said first side wall and a portion of said rear wall, a storage room front wall wherein a display case is provided adjacent said front wall extending parallel to said rear aisle, said storage and stock room further comprising a common wall parallel with said first side wall of said store, and access means being provided through said front wall to allow service personnel to move easily in and out of said storage stock room.

4. The store arrangement according to claim 3 wherein said refrigerated room is a diary and beverage cooler including a rear wall adjacent to said rear store wall, said common wall having an access therethrough to connect said dairy and beverage cooler to said bottle and storage stock room, said cooler further defining a cooler front wall including a series of doors for access to said cooler, said cooler including display shelves located adjacent said doors for access to goods displayed on said shelves by patrons along the rear aisle, said dairy and beverage cooler further defining a cooler side wall opposite said common wall between the storage and stock room having access means adjacent said rear wall to provide access from an area outside the beverage and cooler room for service personnel.

5. The store arrangement according to claim 4 further defining a second counter aisle extending substantially from the front wall of the store to said rear wall of the store parallel to said first counter aisle, said second counter aisle having a front portion, a middle portion and a rear portion, said second counter aisle being displaced from said second side wall of said store, said store arrangement further comprising a bakery area between said second side wall and said middle portion of said aisle.

6. The store arrangement according to claim 5 wherein said bakery area includes a bakery display shelf displaced from said side wall and adjacent and parallel to said middle aisle portion, said bakery area defining a work area between said bakery display shelf and said side wall.

7. The store arrangement according to claim 1, wherein said food preparation area includes a bakery work table displaced from a bakery shelf and forming an aisle therebetween, said second side store wall having baked goods preparation means and supply shelves adjacent thereto and displaced from said work table to define another aisle therebetween parallel to the aisle adjacent the bakery display shelf, said bakery display shelf having a front end and a rear end, the work area further including a bakery wall extending from said front end of the bakery shelf to the second side wall and perpendicular thereto to define a boundary of the work area displaced from said front wall, a sink being located opposite said supply shelves and also displaced from said bakery work table to define an aisle between said bakery work table and said sink, between the supply shelves and the sink.

8. The store arrangement according to claim 7 further comprising a bakery and frozen food freezer having access from said aisle between the sink and supply shelves and having access from the rear portion of the second counter aisle, whereby service personnel can move readily in and out of the bakery and frozen food freezer as well as between the baked goods preparation means in preparation of the items used in connection with the bakery display.

9. The store arrangement according to claim 8 further comprising a free-standing display structure located between the bakery wall and the front wall to define an aisle on either side thereof as well as between said second service counter of the second side member of the U-shaped portion and the second side wall of the store.

10. The store arrangement according to claim 9 further comprising a frozen food display case lying adjacent said side wall between the bakery wall and the front wall and displaced from said free-standing display structure.

11. The store arrangement according to claim 1, wherein said corner sales and service section comprises a cylindrical structure located in the corner defined by the front wall and second side wall, said cylindrical structure having a portion exposed for easy access from the aisles of the store, a shelf extending from said cylindrical structure to separate said cylindrical structure into two sections, said sections being a specialty shop on the side of said shelf contiguous with the access means to the aisles of the store, said cylindrical structure further defining an office on the opposite side of said shelf and exposed to the outside of said store.

12. The store arrangement according to claim 11 wherein said front wall defines entrance and exit access means, located in the center thereof substantially opposite the end counter of said U-shaped central portion and intermediate said service counters on said first and second side counters thereby to provide ready and easy access from the service counter to and from the entrance and exit access means.

* * * * *